United States Patent [19]

Horn et al.

[11] 4,025,284

[45] May 24, 1977

[54] PILOT BURNER REIGNITION SYSTEM

[75] Inventors: Lawrence A. Horn, Clay; Clayton J. Carncross, Utica, both of N.Y.

[73] Assignee: Liberty Combustion Corporation, Syracuse, N.Y.

[22] Filed: Dec. 29, 1975

[21] Appl. No.: 644,764

[52] U.S. Cl. ..... 431/80; 431/27; 361/257

[51] Int. Cl.[2] ..... F23N 5/12

[58] Field of Search ..... 431/78, 80, 27, 79, 431/70, 71, 74; 317/96

[56] References Cited

UNITED STATES PATENTS

| | | | |
|---|---|---|---|
| 3,853,455 | 12/1974 | Riordan et al. | 431/80 |
| 3,870,929 | 3/1975 | Carlson | 431/74 X |
| 3,938,941 | 2/1976 | Patel | 431/80 |

*Primary Examiner*—Edward G. Favors
*Attorney, Agent, or Firm*—Charles S. McGuire

[57] ABSTRACT

A reignition system for a gas burner especially well suited for employment in recreational vehicles, and the like, for operation directly from the vehicle's low voltage DC electrical power supply. A flyback pulse converter, switched by an SCR, converts the low voltage supply to at least 80 volts. Capacitive discharge means produce a spark for relighting the flame in response to a break in the circuit caused by the flame being extinguished.

6 Claims, 1 Drawing Figure

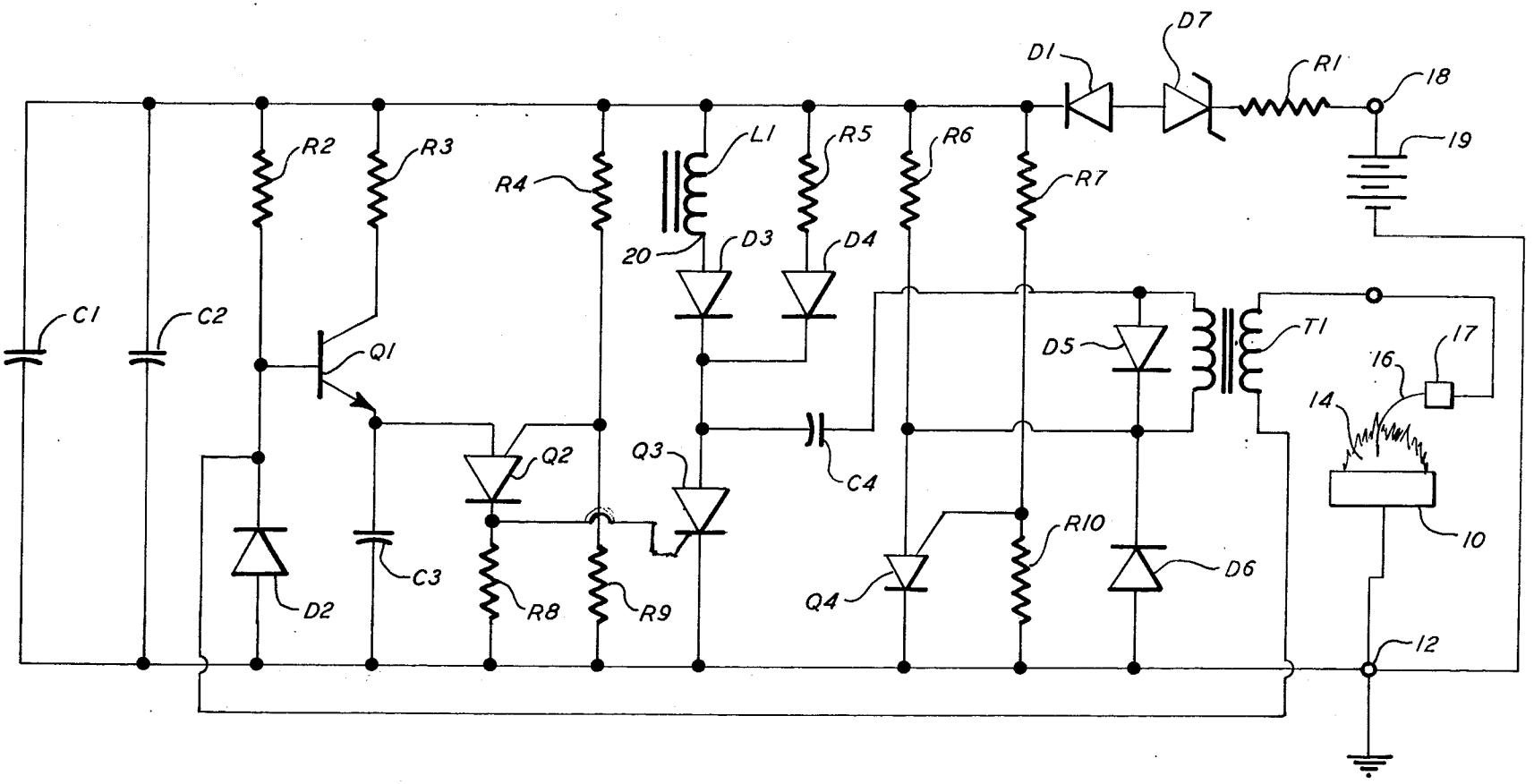
18
19
R1
D7
D1
R7
R6
R5
D4
L1
D3
20
R4
R3
R2
C2
C1
17
16
14
T1
D5
R10
Q4
C4
Q3
R9
Q2
R8
Q1
C3
D2
D6
10
12

PILOT BURNER REIGNITION SYSTEM

BACKGROUND OF THE INVENTION

The present invention relates to automatic pilot flame relighting devices and, more particularly to a novel electronic system for relighting a gas pilot flame which operates from a direct current power source.

In recreational vehicles having pilot lights incorporated in gas burner control systems for refrigerators, water heaters, heating system, and the like, the pilot light flame is sometimes extinguished due to air currents produced by passing vehicles, or by the causes. Although appropriate safety valves are normally provided to shut off the gas supply when the flame is extinguished, it is often inconvenient to relight the pilot burner and the associated equipment may be out of use for some time before the condition is discovered and corrected. This may result in expense due to spoilage of food in refrigerators, inconvenience due to lost travel time and unsafe conditions due to stopping vehicles in busy traffic. Indicator devices have been provided to signal the fact that the flame is out, but it is still necessary to relight the flame.

Automatic pilot flame relighting systems for household use are not suitable for employment in recreational vehicle applications since there is normally no convenient source of alternating current. Prior DC relighting systems have been provided which produce an essentially continuous spark, whether the pilot flame is burning, or not. These systems have the disadvantage of causing electrical interference with other equipment, such as television sets, etc. Other systems, such as some used for main burner ignition, are unsuitable due to their inability to operate reliably with widely varying input voltages. Variations encountered in typical battery converter installations may be as high as 400%. Furthermore, prior systems are generally unsuited to operate from a low voltage DC source, such as a typical vehicle storage battery.

It is a principal object of the present invention to provide a pilot flame relighting system which operates from a low voltage DC source and produces a relighting spark automatically in response to the pilot flame being extinguished.

Another object is to provide a DC pilot flame relighting device which operates with minimal power consumption.

A further object is to provide an automatic pilot light relighting circuit for DC operation which does not produce continuous electrical interference with other electrical appliances in the vicinity.

Still another object is to provide an automatic pilot flame relighting circuit capable of operating with an input voltage which may be subject to wide variations.

Other objects will in part be obvious and will in part appear hereinafter.

SUMMARY OF THE INVENTION

In accordance with the foregoing objects, the invention comprises an electronic circuit having an electrode disposed in the pilot flame of gas burner. The conductivity of the flame completes a circuit through the electrode to an electrically conducting portion of the burner device.

The circuit is powered solely from a low voltage DC source, being intended primarily for operation by a typical storage battery of a recreational type vehicle having gas burning appliances with pilot lights. As used throughout the present specification and claims, the term "low voltage" applies to an electrical power source of 30 volts (root mean square), or less. The circuit includes means, preferably in the form of a flyback pulse converter, for converting the low voltage to a level of at least 80 volts.

The flyback pulse converter powers capacitive discharge means for producing a spark by arcing between the electrode and the burner in response to a break in the circuit caused by extinguishing the flame. The spark is essentially disposed in the fuel supply path and thus serves to reignite the fuel and again complete the circuit between the electrode and burner through the flame. An SCR provides both the means for discharging the capacitor of the capacitive discharge means and the switching means of the flyback pulse converter. The capacitive discharge means and the flyback pulse converter are connected to form a monostable multivibrator.

DETAILED DESCRIPTION

In the schematic diagram of the accompanying drawing, a conventional pilot burner assembly 10 is grounded at 12 to the chassis of a vehicle in which the burner is employed. Pilot flame 14 provides a circuit path between wire 16 of electrode 17 and ground connection 12. Thus, the circuit is broken whenever the pilot flame is extinguished.

A nominal 12 volt DC power source such as battery 19 is connected to terminal 18 on one side and ground connection 12 on the other. The voltage may vary between rather large limits and may be either a constant level or an unfiltered, rectified AC supply such as would normally be encountered in power hook-ups at trailer parks, and the like, without affecting design of the circuit of the present invention. Resistor R1 serves as a current limiting element in the usual manner. Diode D1 protects the circuit from reverse polarity in the event of a mistaken connection. Capacitors C1 and C2 are initially charged through resistor R1 and diode D1 from the primary power source. Capacitor C1 serves as a filter which stores energy when the system is operating with the aforementioned rectified AC, i.e., a pulsating or rippling DC, power supply. Capacitor C2 provides noise suppression and protects the circuit from momentary voltage spikes. Resistor R2 provides an appropriate bias for the base of transistor Q1. Diode D2 protects the base of Q1 during high voltage discharge of transformer T1, and provides a return path for the secondary current from T1.

Trasistor Q1 amplifies the current flowing through resistor R2. The voltage level at the base of transistor Q1 is governed by the voltage divider formed by resistor R2 and the resistance of flame 14. The values of these resistances are such that the voltage at the base of Q1 is low when the pilot burner is lit. When flame 14 is extinguished, the voltage increases rapidly and Q1 then conducts current through resistor R3, charging capacitor C3.

Resistors R4 and R9 form a voltage divider, providing gate bias for programmable unijunction transistor Q2. When the charge on capacitor C3 exceeds the gate bias level, PUT Q2 conducts heavily in the forward direction. Current from capacitor C3 and resistor R4 is conducted through PUT Q2 to the gate of silicon controlled rectifier Q3, and gate bias resistor R8. When capacitor C3 has discharged, resistor R3 and transistor Q1 cannot sustain the required holding current to maintain PUT Q2 in conduction. PUT Q2 returns to the non-conducting state and capacitor C3 begins to recharge slowly.

The initial anode current to SCR Q3 is supplied through resistor R5 and diode D4, to aid in triggering the SCR since some time is required for the current provided through choke L1 and diode D3 to reach the minimum holding current level required by SCR Q3. Diodes D3 and D4 are provided to block the return of high voltage from capacitor C4 to the supply rail.

The right hand side of capacitor C4 is connected to one side of the primary of transformer T1, the other side of which is connected to the anode of PUT Q4 and to the power source through resistor R6. Thus, the right hand side of capacitor C4 is initially charged through the primary of the transformer and resistor R6 toward the supply rail voltage. Resistors R7 and R10 form a voltage divider to supply gate bias for PUT Q4. when the charge on capacitor C4 exceeds the gate bias on PUT Q4, the latter latches and the right hand side of capacitor C4 is near ground potential. The left hand side of capacitor C4 is connected to the supply rail through both resistor R5-diode D4 and choke L1-diode D3. Therefore, the left hand side of capacitor C4 is near the voltage of the supply rail.

When SCR Q3 triggers, the left hand side of capacitor C4 is pulled to ground potential. This produces a negative-going pulse at the anode of PUT Q4. This pulse commutates PUT Q4, allowing the right hand side of capacitor C4 to be charged through resistor R6, until the charge exceeds the gate bias on PUT Q4. The latter then fires, pulling the right hand side of capacitor C4 toward ground potential. This causes a negative-going pulse to be supplied to the anode of SCR Q3. The net sum of the currents from choke L1, resistor R5 and capacitor C4 is less than the minimum holding current required by SCR Q3, whereby the latter is commutated.

The voltage at point 20 is now rapidly rising, due to the rapidly changing current level in choke L1. This voltage level is expressed by the function $V = L\ di/dt$. The dt term is very small, in the low microsecond range, and is governed by the commutation time of SCR Q3. The inductance of the choke (L) is a fixed value. Thus, upon commutation the current change is essentially instantaneous, producing a very large voltage spike at point 20. The voltage spike is conducted through diode D3 to the left hand side of capacitor C4.

Resistor R8 is of low valve, e.g., less than 50 ohms, thus preventing false triggering of SCR Q3 due to rate effect. Diode D3 acts as a catch diode, allowing capacitor C4 to charge, its return path being supplied through diode D5 and PUT Q4. Capacitor C4 is now charged to a high value, e.g., in the 100 volt range. Diodes D3 and D4 prevent this charge from being conducted back to the supply rail through choke L1 and resistor R5.

Capacitor C3 has recharged to a level exceeding the gate bias on PUT Q2, again triggering the latter into forward conduction. Capacitor C3 and resistor R4 again supply current through PUR Q2, triggering SCR Q3 which provides a low impedance path for the left hand side of capacitor C4. Thus, the high voltage on capacitor C4 is dischaarged through diode D6, the primary of transfomer T1, and SCR Q3. This discharge produces a large current spike in the primary of transformer T1. This energy is magnetically coupled to the secondary of transformer T1, producing a high voltage in the secondary winding. The high voltage thus present at electrode device 16 produces an arc in the region of the unlit pilot gas. Diode D2 provides the return path for the seondary current of transformer T1. Diode D5 suppresses ringing in the primary winding.

The aforedescribed circuit operation is thus in the nature of a capaitive discharge device powered by a flyback pulse converter. The latter is formed by choke L1, diodes D3 & D4, resistor R5, R6, R7, R8, and R10, SCR Q3, PUT Q4, and capacitor C4.

When the pilot gas is relit, the low impendance path provided by flame 14 reduces the voltage at the base of transistor Q1, preventing capacitor C3 from charging to a level sufficient to trigger PUT Q2. The cycle will repeat until the pilot gas is relit, or until the system is turned off. If the pilot is not relit within a predetermined time, the safety system will close the supply values of the main and/or pilot gas. In conventional systems this is controlled by a thermocouple which is usually adapted to close the valve in some in something in the order of 90 seconds. Thus, a large number of arcs will be provided between the time the pilot flame is extinguished and the time the pilot gas valve is closed, thus minimizing the possibility that the pilot will fail to be relit. Preferably, the values of the various components of the circuit are such that recycling occurs (i.e., arcing is provided) at a rate of about twice per second.

In some installations it may be desirable to include a zener diode, in the position indicated at D7, to allow the unit to operate on much higher nominal input voltages, e.g., 24v as encountered in many foreign countries. Positive ground operation may be accomplished by removing resistor R2, connecting the emitter of transistor Q1 to ground and connecting the of resistor R3 and collector of transistor Q1 to the junction of capacitor C3 and anode of PUT Q2. Transistor Q1 now acts as a shunt around capacitor C3 until flame 14 is extinguished. In these cases, burner assembly 10 is connected to terminal 18 rather than ground connection 12.

What is claimed is:

1. A flame relighting system comprising:
   a. a source of not greater than 12 volts DC or rectified AC electrical power;
   b. a burner device including an ignitable fuel supply capable of producing a flame;
   c. an electrical circuit completed by the presence of said flame between two spaced electrodes;
   d. a flyback pulse converter connected to and powered solely by said source and adapted to convert said 12 volts of power to a level of at least 80 volts;
   e. capacitive discharge means powered by said flyback pulse converter and adapted to discharge in response to triggering by said flyback pulse converter;
   f. means electrically connecting said discharge means to one of said electrodes, said electrical circuit, pulse converter and discharge means being so constructed and arranged that triggering of said discharge means produces a spark between said two electrodes capable of igniting said fuel supply; and
   g. SCR switching means effective to cause triggering of said discharge means by said pulse converter in response to a break in said electrical circuit produced by absence of said flame.

2. The invention according to claim 1 wherein an SCR is the means for discharging the capacitor of said capacitive discharge means.

3. The invention according to claim 2 wherein said SCR also is the switching means of said flyback pulse converter.

4. The invention according to claim 1 wherein said capacitive discharge means and said flyback pulse converter are connected to provide a monostable multivibrator.

5. The invention according to claim 1 wherein said electrical circuit includes a probe positioned in said flame when said fuel is ignited and so positioned with respect to said burner device that said spark is produced by an arc between said probe and said burner device.

6. The invention according to claim 5 and further including a transformer having a secondary winding to which said probe is connected, said secondary winding being included in said electrical circuit.

* * * * *